US007905094B2

(12) United States Patent
Dudebout et al.

(10) Patent No.: US 7,905,094 B2
(45) Date of Patent: Mar. 15, 2011

(54) COMBUSTOR SYSTEMS WITH LINERS HAVING IMPROVED COOLING HOLE PATTERNS

(75) Inventors: Rodolphe Dudebout, Phoenix, AZ (US); Paul R. Yankowich, Phoenix, AZ (US); Frank J. Zupanc, Phoenix, AZ (US); Ronald B. Pardington, Gilbert, AZ (US)

(73) Assignee: Honeywell International Inc., Morristown, NJ (US)

( * ) Notice: Subject to any disclaimer, the term of this patent is extended or adjusted under 35 U.S.C. 154(b) by 725 days.

(21) Appl. No.: 11/863,791

(22) Filed: Sep. 28, 2007

(65) Prior Publication Data

US 2009/0084110 A1 Apr. 2, 2009

(51) Int. Cl.
*F02C 1/00* (2006.01)

(52) U.S. Cl. ..... 60/752

(58) Field of Classification Search ..... 60/752–760; 431/351–353

See application file for complete search history.

(56) References Cited

U.S. PATENT DOCUMENTS 5,241,827 A * 9/1993 Lampes ..... 60/754
5,261,223 A * 11/1993 Foltz ..... 60/804
6,192,689 B1 * 2/2001 Feitelberg et al. ..... 60/752
6,655,149 B2 * 12/2003 Farmer et al. ..... 60/754
7,310,938 B2 * 12/2007 Marcum et al. ..... 60/39.37
7,669,422 B2 * 3/2010 Suleiman et al. ..... 60/772
2006/0037323 A1 * 2/2006 Reynolds et al. ..... 60/754
2006/0196188 A1 * 9/2006 Burd et al. ..... 60/754
2006/0272335 A1 12/2006 Schumacher et al.
2007/0006588 A1 1/2007 Patel et al.
2007/0084219 A1 * 4/2007 Bernier et al. ..... 60/804
2007/0169484 A1 * 7/2007 Schumacher et al. ..... 60/754
2007/0234727 A1 * 10/2007 Patel et al. ..... 60/754
2007/0271925 A1 * 11/2007 Alkabie et al. ..... 60/772

* cited by examiner

*Primary Examiner* — Michael Cuff
*Assistant Examiner* — Phutthiwat Wongwian
(74) *Attorney, Agent, or Firm* — Ingrassia Fisher & Lorenz, P.C.

(57) ABSTRACT

A combustor liner assembly includes a liner and a first group of cooling holes formed in the liner and having an increasing density in a downstream direction. The first group of cooling holes include a generally circumferential first row of cooling holes, a generally circumferential second row of cooling holes immediately downstream from, consecutive to, and separated from the first row at a first distance, a generally circumferential third row of cooling holes immediately downstream from, consecutive to, and separated from the second row at a second distance, and a generally circumferential fourth row of cooling holes immediately downstream from, consecutive to, and separated from the third row at a third distance. The first distance is greater than the second distance and the third distance, and the second distance is greater than the third distance.

18 Claims, 3 Drawing Sheets

COMBUSTOR SYSTEMS WITH LINERS HAVING IMPROVED COOLING HOLE PATTERNS

TECHNICAL FIELD

The present invention relates generally to combustor systems, and more particularly to combustor systems with liners having improved effusion cooling hole patterns.

BACKGROUND

Typically, a combustor system for a gas turbine engine includes outer and inner casings that house outer and inner liners. The liners and casings are radially spaced apart to form a passage for compressed air. The inner and outer liners form a combustion chamber within which compressed air mixes with fuel and is ignited. As such, each of the liners includes a hot side exposed to hot combustion gases and a cold side facing the passage formed between the liners and the casings. The liner may also be a dual wall construction, where the side of the liner which is exposed to the combustion gases is thermally decoupled from the side which is exposed to compressor discharge gases, thereby forming an intervening cavity.

In typical combustors, a plurality of effusion cooling holes supply a thin layer of cooling air that insulates the hot sides of the liners from extreme combustion temperatures. The liners also include major openings, much larger than the cooling holes, for the introduction of compressed air to feed the combustion process. The thin layer of cooling air can be disrupted by flow through the major openings, potentially resulting in elevated liner temperatures adjacent the major openings. Elevated or uneven temperature distributions within the liners can promote undesired oxidation of the liner material, coating-failure, or thermally induced stresses that degrade the effectiveness, integrity, and life of the liners.

It is known to arrange cooling holes in a dense grouping upstream of major openings, in the primary combustion zone where higher radiation loads and temperatures are located, to distribute ample cooling airflow in regions via film cooling and effective heat removal through the thickness of the liners by convection along the surfaces of the holes. Disadvantageously, the greater flow through the major openings can disrupt the flow of cooling air around the major openings. This situation can result in a deficiency of cooling air downstream of the major openings that may cause an undesirable increase in liner temperature. Further, the overall amount of cooling airflow is limited and it is therefore desirable to efficiently allocate available cooling airflow to provide even temperature distribution throughout the liner.

Accordingly, it is desirable to develop combustor systems with liners that improve cooling layer properties, particularly adjacent to major openings, to eliminate uneven temperature distributions or undesirable temperature levels. Furthermore, other desirable features and characteristics of the present invention will become apparent from the subsequent detailed description of the invention and the appended claims, taken in conjunction with the accompanying drawings and this background of the invention.

BRIEF SUMMARY

In one exemplary embodiment, a combustor liner assembly includes a liner and a first group of cooling holes formed in the liner and having an increasing density in a downstream direction.

In another exemplary embodiment, a combustor system includes an inner liner; and an outer liner circumscribing the inner liner and forming a combustion chamber therebetween for the combustion of a fuel and air mixture. The outer liner includes a first group of cooling holes having an increasing density in a downstream direction.

In yet another exemplary embodiment, a combustor liner assembly includes an inner liner and an outer liner circumscribing the inner liner to form a combustion chamber therebetween. The inner liner includes a first group of cooling holes having an increasing density in a downstream direction, a second group of cooling holes downstream of the first group and having a constant density, and a third group of cooling holes downstream of the second group and having a varying density. The inner liner includes a fourth group of cooling holes having an increasing density in the downstream direction, a fifth group of cooling holes downstream of the fourth group and having a constant density, and a sixth group of cooling holes downstream of the fifth group and having a varying density.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
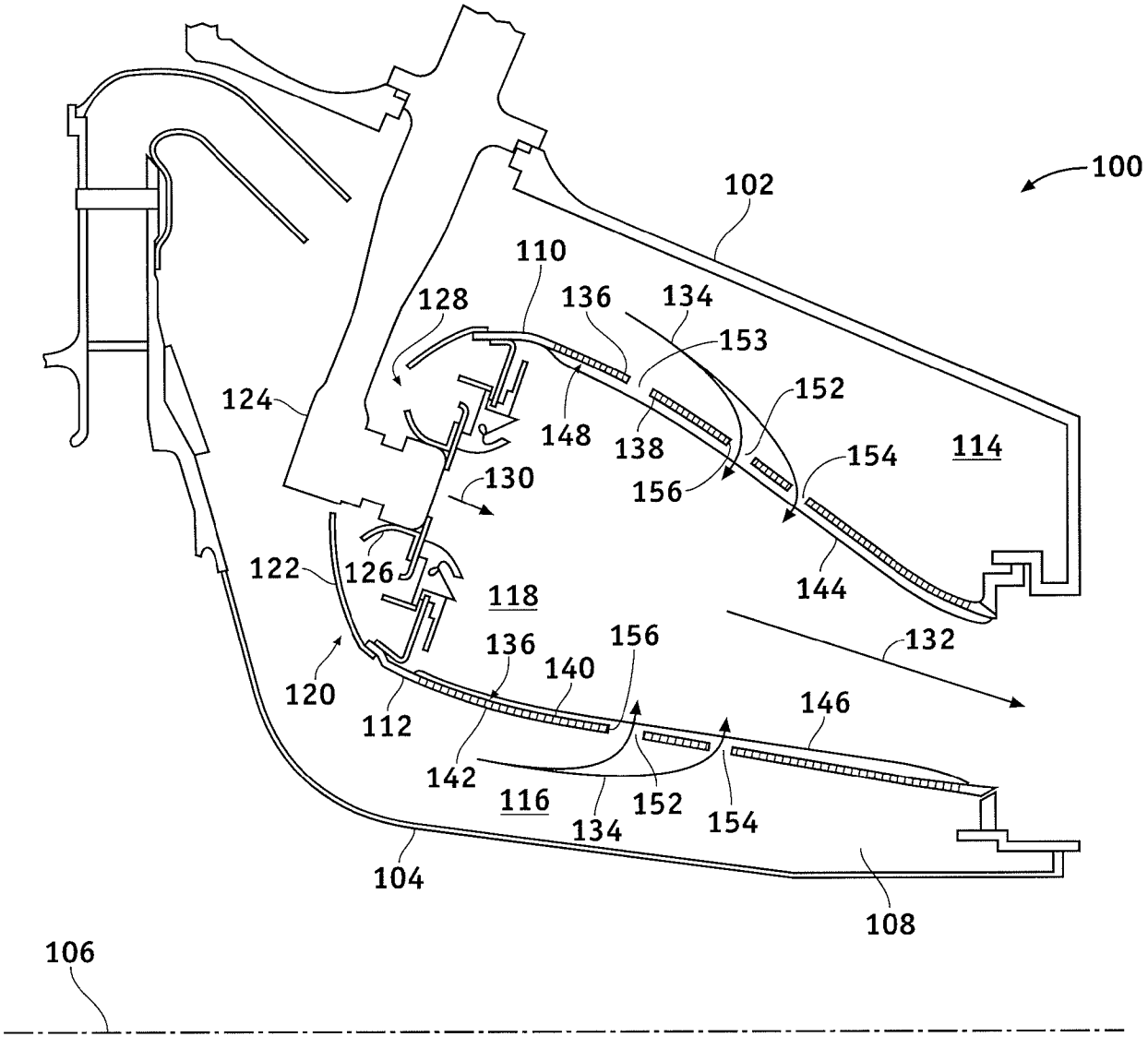
FIG. 1 is a cross-sectional view of a combustor assembly in accordance with an exemplary embodiment.

FIG. 1 is a cross-sectional view of a combustor assembly 100 in accordance with an exemplary embodiment. The combustor assembly 100 includes an outer casing 102 and an inner casing 104. The outer and inner casings 102, 104 circumscribe an axially extending engine centerline 106 to define an annular pressure vessel 108. Within the annular pressure vessel 108, an outer liner 110 and inner liner 112 are respectively radially spaced apart from the outer casing 102 and the inner casing 104 to form outer and inner air plenums 114, 116. The outer and inner liners 110, 112 can be single-wall or double-wall construction, single-piece construction or segmented construction in the form of discrete heat shields, panels or tiles. The outer and inner liners 110, 112 are radially spaced apart to define a combustion chamber 118.

The combustor assembly 100 further includes a front end assembly 120 at a forwardmost end of the combustion chamber 118. The front end assembly 120 comprises an annularly extending shroud 122, fuel injectors 124, and fuel injector guides 126. One fuel injector 124 and one fuel injector guide 126 are shown in the cross-sectional view of FIG. 1. In one embodiment, the combustor assembly 100 includes a total of sixteen circumferentially distributed fuel injectors 124, but it will be appreciated that the combustor assembly 100 could be implemented with more or less than this number of fuel injectors 124.

The shroud 122 extends between and is secured to the forwardmost ends of the outer and inner liners 110, 112. The shroud 122 includes a plurality of circumferentially distributed shroud ports 128 that accommodate the fuel injectors 124 and introduce air into the forward end of the combustion chamber 118. Each fuel injector 124 is secured to the outer casing 102 and projects through one of the shroud ports 128. Each fuel injector 124 introduces a swirling, intimately blended fuel-air mixture 130 that supports combustion in the combustion chamber 118.

During operation, fuel and air within the combustion chamber 118 are ignited to generate hot combustion gases 132. Compressed air 134 is fed into the plenums 114, 116 and further into the combustion chamber 118 to feed the combustion process. The hot combustion gases 132 exit the combustion chamber 118 at speeds and elevated temperatures required to provide energy that drives a turbine (not shown), as is known.

The outer liner 110 includes a hot side 138 that is exposed to the hot combustion gases 132 and a cool side 136 facing the plenum 114. Similarly, the inner liner 112 includes a hot side 140 that is exposed to the hot combustion gases 132 and a cool side 142 facing the plenum 116. The hot sides 138, 140 of the outer and inner liners 110, 112 are respectively insulated from the extreme heat and radiation generated by the hot combustion gases 132 by layers of cooling airflow 144, 146. The layer of cooling airflow 144 is supplied by a plurality of effusion cooling holes 148 arranged throughout the outer liner 110, and the layer of cooling airflow 146 is supplied by a plurality of effusion cooling holes 150 arranged throughout the inner liner 112. The cooling holes 148, 150 also provide a mechanism for additional cooling via convection along the surface areas of the cooling holes 148, 150. The cooling holes 148 of the outer liner 110 and the cooling holes 150 of the inner liner 112 can have the same or different patterns. The cooling holes 148, 150 are better illustrated in the more detailed views of FIGS. 2 and 3 and described in greater detail below.

In addition to the cooling holes 148, 150, the outer and inner liners 110, 112 also respectively include major openings 152, 154 that are relatively larger than the cooling holes 148, 150. The major openings 152, 154 can be dilution, quench or trim holes supplying air for combustion and to tailor the combustor exit temperature distribution. Further, the major openings 152, 154 can be borescope holes or igniter portholes. Each of the major openings 152, 154 can disrupt the layers of cooling airflow 144, 146, thereby reducing the effective cooling around the corresponding major opening 152, 154. An igniter port hole 153 may also be provided in the outer liner 110. Other major openings, in the form of access ports, and other geometric obstructions or protrusions may also be significant enough to impact cooling flow similarly.

The cooling airflow 144, 146 may be generated by the angular orientation of the cooling holes 148, 150 throughout the outer and inner liners 110, 112. The cooling holes 148, 150 are angled from the cool sides 136, 142 to the hot sides 138, 140. Each cooling hole 148, 150 is disposed at a simple or compound angle relative to the hot side 138, 140 of the outer and inner liners 110, 112. The cooling airflow 144, 146 through the cooling holes 148, 150 may generate directional flow axially, circumferentially or both axially and circumferentially along the hot sides 138, 140 of the outer and inner liners 110, 112 that create the thin air film of radial thickness that insulates the outer and inner liners 110, 112 from the hot combustion gases 132.

The cooling holes 148, 150 may also be axially slanted from the cool sides 136, 142 to the hot side 138, 140 at axial angle. Preferably, the axial angle is between 10 and 45 degrees. In another example, the axial angle is between 20 to 30 degrees relative to the hot side 138, 140 of each of the outer and inner liners 110, 112. The cooling holes 148, 150 are also disposed at a transverse angle oriented circumferentially to provide a preferential cooling air flow orientation along the entire surface of the outer and inner liners 110, 112. The transverse angle can be as much as 90 degrees relative to an axial coordinate of the combustion chamber 118. It can be appreciated that other angles of the cooling holes 148, 150 can be provided to produce a desired cooling airflow 144, 146.

Compressed air 134 flowing through the major openings 152, 154 generates three-dimensional airflows along the hot side surfaces 138, 140 of the outer and inner liners 110, 112. As discussed above, the three-dimensional flows disrupt the cooling airflow 144, 146 adjacent the surface of the outer and inner liners 110, 112. As cooling airflow 144, 146 approaches the major openings 152, 154 and the airflow 134 therethrough, the cooling airflow 144, 146 can stagnate at a leading edge 156 of the major opening 152 and generate three-dimensional or recirculating flows. The local stagnation pressures, associated pressure gradients and flow patterns drive the cooling airflow 144, 146, if inadequate, away from the surface areas in the vicinity of the major opening 152 and locally depress or siphon flow locally from cooling holes 148, 150. These factors may reduce cooling effectiveness. Further, if airflow 134 from the major openings 152, 154 is of significant momentum or pressure gradients of ample strength, cooling airflow 144, 146 may lift off the hot sides 138, 140, which can result in uneven temperatures at localized areas of the outer and inner liners 110, 112.

Figure 2:
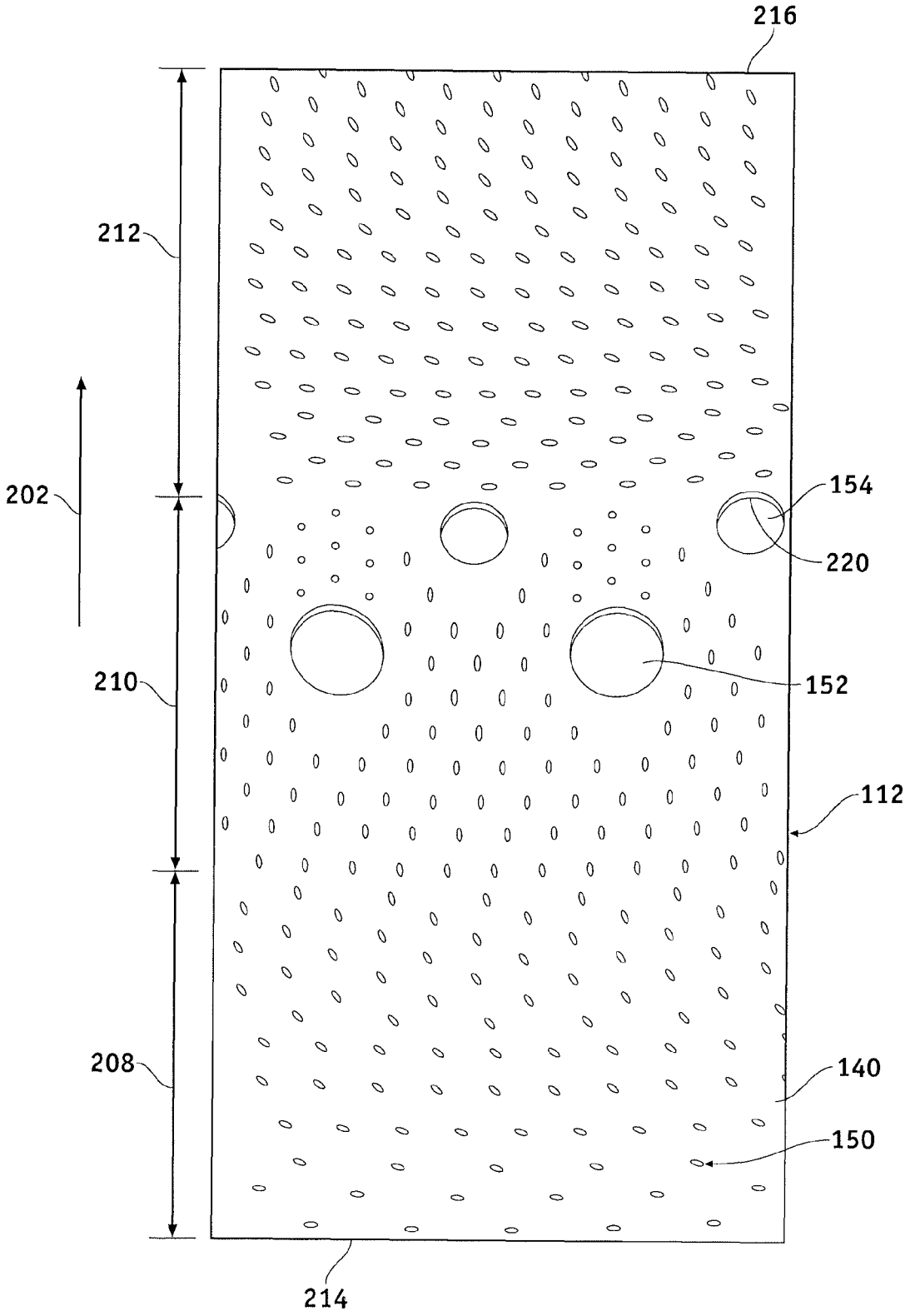
FIG. 2 is an enlarged plan view of a section of an inner liner of the combustor assembly of FIG. 1.

FIG. 2 is an enlarged plan view of a section of an inner liner 112 of the combustor assembly 100 of FIG. 1. The combustor assembly 100 includes the cooling holes 148 disposed in specific patterns and densities relative to the major openings 152, 154 to effect local cooling. The patterns of the cooling holes 150 provide for the build up and dense placement of cooling airflow 146 (FIG. 1) upstream of the major openings 152 and immediately adjacent the opening 154 to overcome local combustor aerodynamics and undesired heat transfer patterns.

The cooling holes 150 may have a diameter of about 0.01-0.05 inches. The cooling holes 150 may have circular or non-circular shapes, such as oval, egg-shaped, diverging or tapered.

The cooling holes 150 are spaced in patterns that need not be symmetric or geometrically repeating. Generally, the cooling holes 150 are disposed in patterns such that the greatest amount of cooling air is provided in areas that require the greatest cooling, i.e., "hot spots," such as adjacent the major openings 152, 154 and in areas adjacent the end of the combustion chamber 118. As discussed above, the hot spots may be a result of disruptive airflows, generally increased temperature of the combustion gases 132 in certain areas, or the geometries of the combustion chamber 118.

In one exemplary embodiment, a first group 208 of cooling holes 150 is disposed adjacent an upstream end 214 of the inner liner 112. The first group 208 of cooling holes 150 may range in densities from about 5-20 holes per square inch to about 30-80 holes per square inch. Generally, the density of the cooling holes 150 in the first group 208 increases in a downstream direction 202. This provides a smooth transition for the build up of the cooling airflow 146 (FIG. 1), as well as a smooth transition between the first group 208 of cooling holes 150 and downstream groups. The smooth transition also provides a more efficient use of cooling air. In one embodiment, the density of the cooling holes 150 is about 10 holes per square inch immediately adjacent the upstream end 214 of the inner liner 112, and the density of the cooling holes 150 increases to about 40 holes per square inch adjacent the termination of the first group 208. The density of cooling holes 150 of the first group 208 can increase at a constant rate or a varying rate. In another embodiment, the first group 208 of cooling holes 150 can be arranged in a plurality of rows, and the distances between each of the plurality of rows decreasing in the downstream direction 202. As an example, the distances between consecutive rows can decrease at a rate of 10-15% per row.

A second group 210 of cooling holes 150 is disposed adjacent the first group 208 of cooling holes 150 in the downstream direction 202 and extends to the downstream edge 220 of the major openings 154. The second group 210 of cooling holes 150 may range in density from about 30-80 holes per square inch. In one embodiment, the second group 210 of cooling holes 150 has the same density as the last rows of first group 208 of cooling holes 150, such as, for example, 40 holes per square inch. Generally, the density of the cooling holes 150 in the second group 210 is constant.

A third group 212 of cooling holes 150 is disposed adjacent the second group 210 of cooling holes 150 in the downstream direction 202. The third group 212 of cooling holes 150 generally extends to the downstream edge 216 of the inner liner 112, which is typically the exit of the combustion chamber 118 (FIG. 1) that mates with a turbine (not shown). The third group 212 of cooling holes 150 may range in density from about 5-80 holes per square inch. In one embodiment, the density of the cooling holes 150 of the third group 212 varies. The density of the third group 212 can particularly vary to provide the most effective cooling pattern. As an example, the third group 212 of cooling holes 150 can initially have a relatively high density adjacent the downstream side 220 of major openings 154. The third group 212 of cooling holes 150 may then have a relatively lower density, and finally gradually increase in density to the downstream edge 216 of the inner liner 112, in order to overcome the increased convective heating of the hot gases accelerating towards the turbine.

Figure 3:
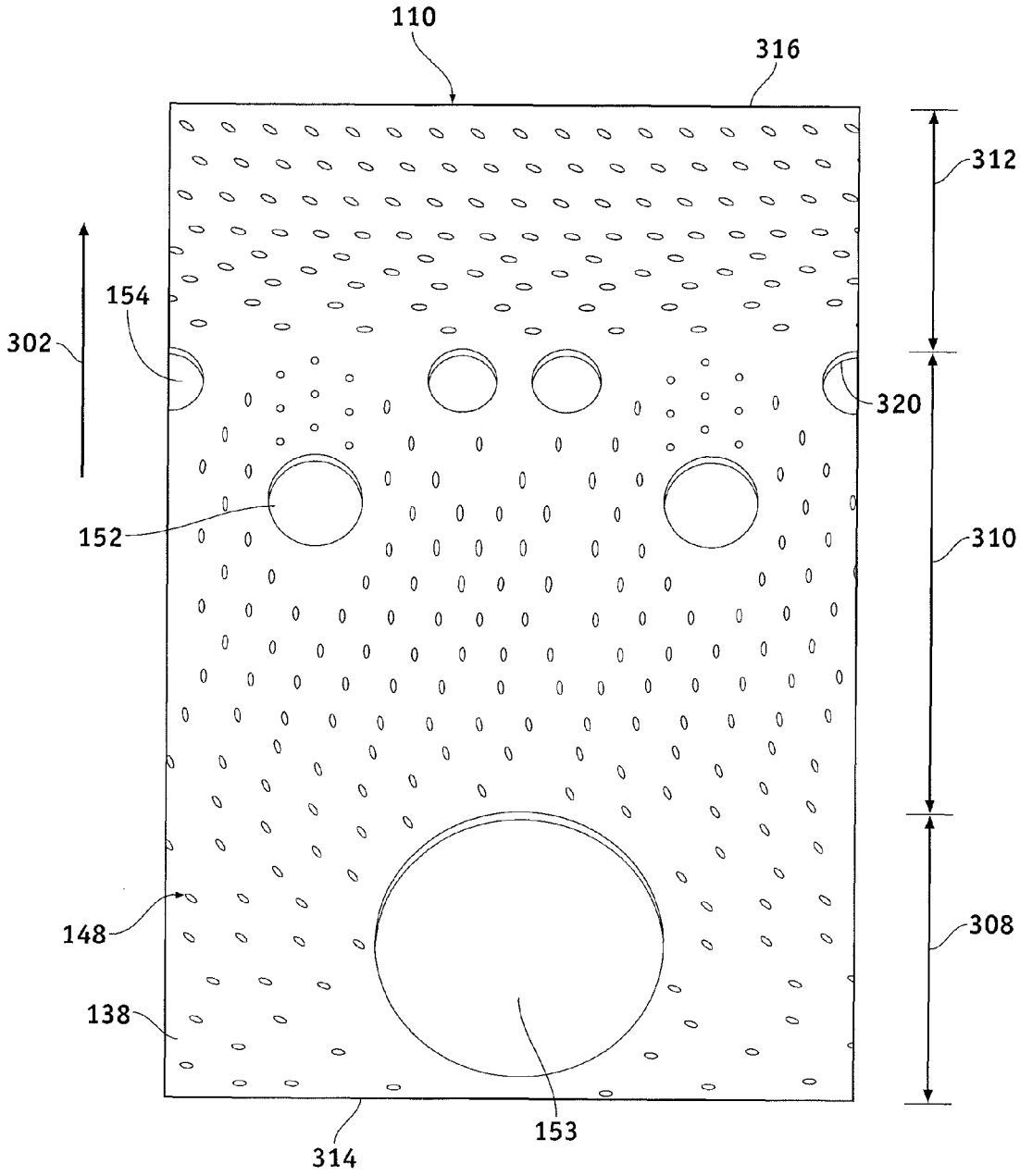
FIG. 3 is an enlarged plan view of a section of an outer liner of the combustor assembly of FIG. 1.

FIG. 3 is an enlarged plan view of a section of an outer liner 110 of the combustor assembly 100 of FIG. 1. The combustor assembly 100 includes the cooling holes 148 disposed in specific patterns and densities relative to the major openings 152, 154 to effect local cooling. The patterns of the cooling holes 148 provide for the build up and dense placement of cooling airflow 144 (FIG. 1) upstream of the major openings 152 and immediately adjacent the opening 154 to overcome local combustor aerodynamics and undesired heat transfer patterns. The cooling holes 148 can have a geometric configuration similar to the cooling holes 150.

The cooling holes 148 are spaced in patterns that need not be symmetric or geometrically repeating. Generally, the cooling holes 148 are disposed in patterns such that the greatest amount of cooling air is provided in areas that require the greatest cooling, i.e., "hot spots," such as adjacent the major openings 152, 154 and in areas adjacent the end of the combustion chamber 118. As discussed above, the hot spots may be a result of disruptive airflows, generally increased temperature of the combustion gases 132 in certain areas, or the geometries of the combustion chamber 118.

In one exemplary embodiment, a first group 308 of cooling holes 148 is disposed adjacent an upstream end 314 of the outer liner 110. The first group 308 of cooling holes 148 may range in densities from about 5-20 holes per square inch to about 30-80 holes per square inch. Generally, the density of the cooling holes 148 in the first group 308 increases in a downstream direction 302. This provides a smooth transition for the build up of the cooling airflow 144 (FIG. 1), as well as a smooth transition between the first group 308 of cooling holes 148 and downstream groups. The smooth transition also provides a more efficient use of cooling air. In one embodiment, the density of the cooling holes 148 is about 10 holes per square inch immediately adjacent the upstream end 314 of the outer liner 110, and the density of the cooling holes 148 increases to about 40 holes per square inch adjacent the termination of the first group 308. The density of cooling holes 148 of the first group 308 can increase at a constant rate or a varying rate. In another embodiment, the first group 308 of cooling holes 148 can be arranged in a plurality of rows, and the distances between each of the plurality of rows decreasing in the downstream direction 302. As an example, the distances between consecutive rows can decrease at a rate of 10-15% per row.

A second group 310 of cooling holes 148 is disposed adjacent the first group 308 of cooling holes 148 in the downstream direction 302 and extends to the downstream edge 320 of the major openings 154. The second group 310 of cooling holes 148 may range in density from about 30-80 holes per square inch. In one embodiment, the second group 310 of cooling holes 148 has the same density as the last rows of first group 308 of cooling holes 148, such as, for example, 40 holes per square inch. Generally, the density of the cooling holes 148 in the second group 310 is constant.

A third group 312 of cooling holes 148 is disposed adjacent the second group 310 of cooling holes 148 in the downstream direction 302. The third group 312 of cooling holes 148 generally extends to the downstream edge 316 of the outer liner 110, which is typically the exit of the combustion chamber 118 (FIG. 1) that mates with a turbine (not shown). The third group 312 of cooling holes 148 may range in density from about 5-80 holes per square inch. In one embodiment, the density of the cooling holes 148 of the third group 312 varies. The density of the third group 312 can particularly vary to provide the most effective cooling pattern. As an example, the third group 312 of cooling holes 148 can initially have a relatively high density adjacent the downstream side 320 of major openings 154. The third group 312 of cooling holes 148 may then have a relatively lower density, and finally gradually increase in density to the downstream edge 316 of the outer liner 110, in order to overcome the increased convective heating of the hot gases accelerating towards the turbine.

Although several patterns and of hole density patterns have been illustrated by way of the example, it will be recognized that different hole patterns and densities can be provided. Further, although three different spacing of cooling holes 148 are shown in the example embodiments, the number of and relative difference between different hole spacings and groups may be adjusted.

The combustor assembly 100 includes the cooling holes 148, 150 disposed in specific patterns and densities relative to the major openings 152, 154 to effect local cooling. The denser cooling hole patterns provide for increased cooling flow in areas where cooling airflow 144, 146 effectiveness is degraded, and is an efficient method of utilizing the limited volume of available cooling air.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A combustor liner assembly comprising:

a liner having an inner surface configured to be exposed to a combustion gas;

a first group of cooling holes formed in the liner and having an increasing density in a downstream direction, wherein the first group of cooling holes include a generally circumferential first row of cooling holes, a generally circumferential second row of cooling holes immediately downstream from, consecutive to, and separated from the first row at a first distance, a generally circumferential third row of cooling holes immediately downstream from, consecutive to, and separated from the second row at a second distance, and a generally circumferential fourth row of cooling holes immediately downstream from, consecutive to, and separated from the third row at a third distance, wherein the first distance is greater than the second distance and the third distance, and the second distance is greater than the third distance.

2. The combustor liner assembly of claim 1, wherein the first group of cooling holes has a density between approximately 5 holes per square inch and 80 holes per square inch.

3. The combustor liner assembly of claim 1, wherein the first group of cooling holes has a first density in an upstream portion of about 10 holes per square inch and a second density in a downstream portion of about 40 holes per square inch.

4. The combustor liner assembly of claim 1, wherein the first group of cooling holes has a first density in an upstream portion in a range of about 5 holes per square inch to about 20 holes per square inch, and a second density in a downstream portion in a range of about 30 holes per square inch to about 80 holes per square inch.

5. The combustor liner assembly of claim 1, further comprising a second group of cooling holes formed in the liner downstream of the first group and having a constant density.

6. The combustor liner assembly of claim 5, wherein density of cooling holes in the first group has a smooth transition to the cooling holes of the second group.

7. The combustor liner assembly of claim 5, further comprising a plurality of major openings within the second group of cooling holes.

8. The combustor liner assembly of claim 7, further comprising a third group of cooling holes formed in the liner immediately downstream of the major openings and having a varying density.

9. The combustor liner assembly of claim 5, further comprising a third group of cooling holes formed in the liner downstream of the second group and having a varying density.

10. A combustor system, comprising:

an inner liner; and an outer liner circumscribing the inner liner and forming a combustion chamber therebetween for the combustion of a fuel and air mixture, the outer liner comprising a first group of cooling holes having an increasing density in a downstream direction, wherein the first group of cooling holes include a generally circumferential first row of cooling holes, a generally circumferential second row of cooling holes immediately downstream from, consecutive to, and separated from the first row at a first distance, a generally circumferential third row of cooling holes immediately downstream from, consecutive to, and separated from the second row at a second distance, and a generally circumferential fourth row of cooling holes immediately downstream from, consecutive to, and separated from the third row at a third distance, wherein the first distance is greater than the second distance and the third distance, and the second distance is greater than the third distance.

11. The combustor system of claim 10, wherein the first group of cooling holes has a density between approximately 5 holes per square inch and 80 holes per square inch.

12. The combustor system of claim 10, wherein the first group of cooling holes has a first density in an upstream portion of about 10 holes per square inch and a second density in a downstream portion of about 40 holes per square inch.

13. The combustor system of claim 10, wherein the first group of cooling holes has a first density in an upstream portion in a range of about 5 holes per square inch to about 20 holes per square inch, and a second density in a downstream portion in a range of about 30 holes per square inch to about 80 holes per square inch.

14. The combustor system of claim 10, wherein the outer liner further comprises a second group of cooling holes downstream of the first group and having a constant density.

15. The combustor system of claim 14, wherein density of cooling holes in the first group has a transition to the cooling holes of the second group.

16. The combustor system of claim 13, wherein the outer liner further comprises a plurality of major openings within the second group of cooling holes.

17. The combustor system of claim 15, wherein the outer liner further comprises a third group of cooling holes formed in the liner immediately downstream of the second group and having a varying density.

18. A combustor liner assembly comprising:

an inner liner comprising a first group of cooling holes having an increasing density in a downstream direction, wherein the first group of cooling holes include a generally circumferential first row of cooling holes, a generally circumferential second row of cooling holes immediately downstream from, consecutive to, and separated from the first row at a first distance, a generally circumferential third row of cooling holes immediately downstream from, consecutive to, and separated from the second row at a second distance, and a generally circumferential fourth row of cooling holes immediately downstream from, consecutive to, and separated from the third row at a third distance, wherein the first distance is greater than the second distance and the third distance, and the second distance is greater than the third distance, a second group of cooling holes downstream of the first group and having a constant density, and a third group of cooling holes downstream of the second group and having a varying density; and an outer liner circumscribing the inner liner to form a combustion chamber therebetween, the outer liner comprising a fourth group of cooling holes having an increasing density in the downstream direction, a fifth group of cooling holes downstream of the fourth group and having a constant density, and a sixth group of cooling holes downstream of the fifth group and having a varying density.

* * * * *